US008381346B2

(12) United States Patent
Cavalcanti et al.

(10) Patent No.: US 8,381,346 B2
(45) Date of Patent: Feb. 26, 2013

(54) BUTTERFLY MOP WITH INTERNAL WRINGING ACTUATOR

(75) Inventors: Robert Cavalcanti, Shrewsbury, MA (US); Michael Silverman, Westborough, MA (US); Robert Michelson, Wayland, MA (US)

(73) Assignee: Butler Home Products, LLC, Marlborough, MA (US)

( * ) Notice: Subject to any disclaimer, the term of this patent is extended or adjusted under 35 U.S.C. 154(b) by 865 days.

(21) Appl. No.: 12/403,833

(22) Filed: Mar. 13, 2009

(65) Prior Publication Data

US 2009/0249568 A1 Oct. 8, 2009

Related U.S. Application Data

(60) Provisional application No. 61/069,532, filed on Mar. 14, 2008.

(51) Int. Cl.
*A47L 13/20* (2006.01)

(52) U.S. Cl. ..... 15/119.2; 15/244.1; 15/244.2; 15/244.4

(58) Field of Classification Search ..... 15/119.2, 15/228; *A47L 13/20*
See application file for complete search history.

(56) References Cited

U.S. PATENT DOCUMENTS

| | | | | |
|---|---|---|---|---|
| 4,831,677 | A * | 5/1989 | Morrison et al. | 15/119.2 |
| 5,138,736 | A * | 8/1992 | Pesa | 15/119.2 |
| 7,269,875 | B1 * | 9/2007 | Grimes | 15/119.2 |
| 2002/0120994 | A1 * | 9/2002 | Hirse | 15/119.2 |
| 2003/0101527 | A1 * | 6/2003 | Specht et al. | 15/119.2 |
| 2007/0089255 | A1 * | 4/2007 | Michelson et al. | 15/144.3 |

* cited by examiner

*Primary Examiner* — Monica Carter
*Assistant Examiner* — Stephanie N Berry
(74) *Attorney, Agent, or Firm* — McCarter & English LLP

(57) ABSTRACT

A mop having a handle with a wringing frame disposed at a distal end, which defines a cam slot. An actuator lever is pivotally attached to the handle intermediate the distal and proximal ends and is coupled to an actuator linkage that extends into the internal hollow of the handle and connects to a pad plate, which supports a cleaning pad, such as a sponge thereon at the distal end of the mop. The pad plate has hinges that permit it to bend upon itself. When the actuator lever is moved to wring the cleaning pad, the actuator linkage pulls the pad plate at least partially through the cam slot, causing it to bend at the hinges and wring the cleaning pad supported thereon.

11 Claims, 18 Drawing Sheets

BUTTERFLY MOP WITH INTERNAL WRINGING ACTUATOR

CROSS-REFERENCE TO PRIORITY APPLICATION

This patent application claims priority to U.S. provisional patent application Ser. No. 61/069,532, filed Mar. 14, 2008, entitled "Butterfly Mop with Internal Wringing Actuator", which is hereby expressly incorporated by reference in its entirety as part of the present disclosure.

FIELD OF THE INVENTION

The present invention relates to mops and more particularly to butterfly style sponge mops with an internal wringer apparatus.

BACKGROUND OF THE INVENTION

Various types of mops are known, including sponge mops having a wringer apparatus to facilitate wetting, soaping and rinsing a cleaning pad or sponge disposed at the end of the mop. One type of sponge mop is commonly referred to as a butterfly mop because the wringing mechanism presses opposing portions of the mop head together to wring the sponge or pad at the end of the mop. Mops with a remote wringer actuator which permits the operator to wring the sponge without touching the mop head are known. For example, one type of actuator uses a slide handle disposed intermediate the proximal end of the mop and the mop head. The slide handle is connected to a linkage which presses two opposing portions of the mop head together to wring the sponge. Typically, remote wringing mops utilize a actuator mechanism with external parts. The external parts can be damaged, or can cause damage to walls or furniture, during use. Accordingly, notwithstanding the existence of known butterfly mop wringing apparatus, a need exists for an improved mop and wringing mechanism.

SUMMARY

The limitations of prior art mops are addressed by the present invention, which includes a mop having a handle with a wringing frame disposed proximate a distal end thereof, defining an opening. An actuator linkage extends from a position on the handle intermediate the distal end and a proximal end thereof to a position proximate the distal end of the handle. The actuator linkage is at least partially internally housed within the handle. A pad plate is coupled to the actuator linkage proximate the distal end of the handle and supports a cleaning pad thereon. The actuator linkage may be selectively actuated to pull the pad plate at least partially through the opening to wring the cleaning pad.

DETAILED DESCRIPTION OF PREFERRED EMBODIMENTS

Figure 1:
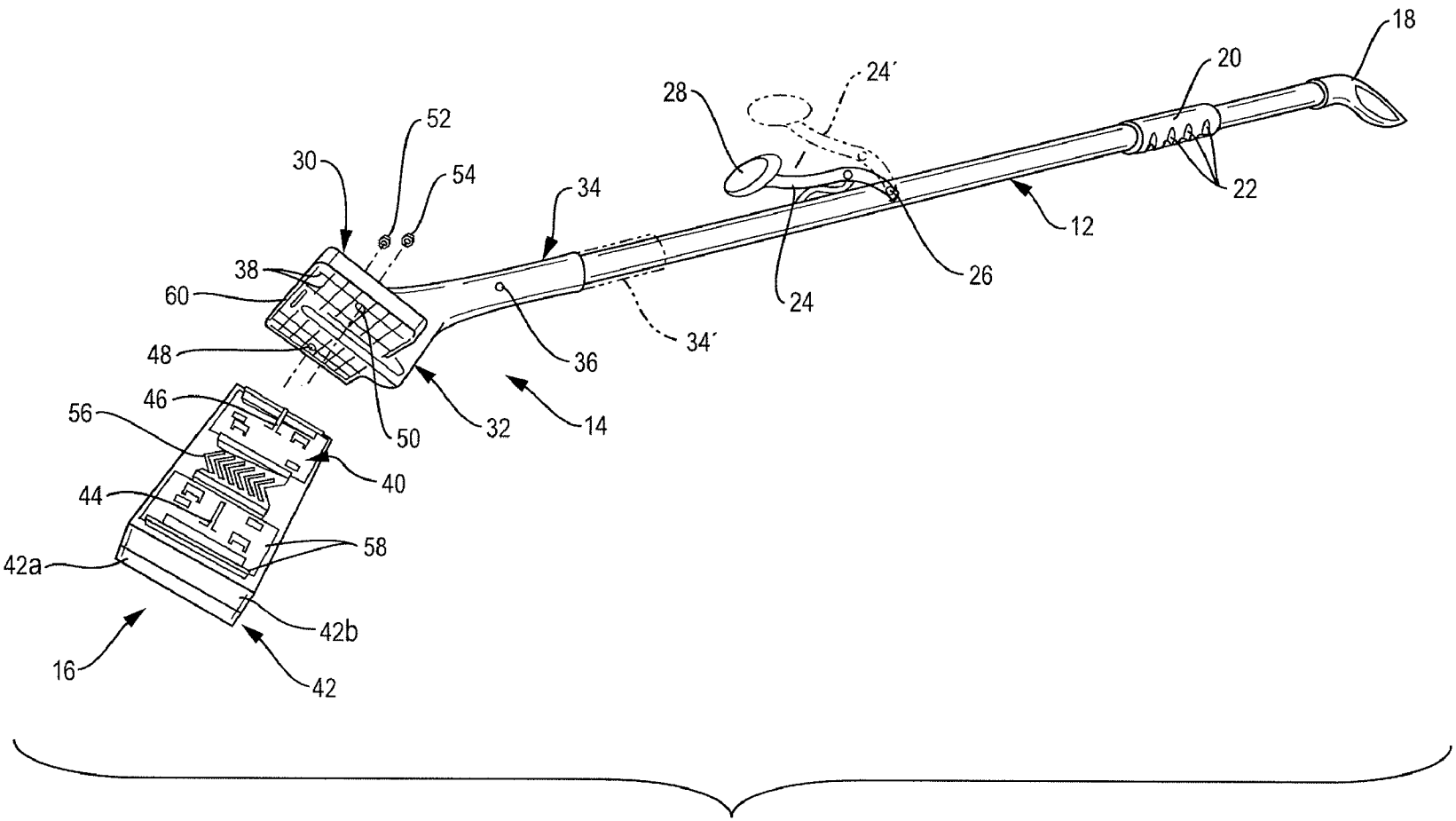
FIG. 1 is perspective, partially exploded view of a mop in accordance with an embodiment of the present invention.

FIG. 1 shows a mop 10 having a handle 12 and a pad support assembly 14. The pad support assembly 14 supports a cleaning pad 16, such as a sponge. The handle 12 may be provided with a proximal hand grip 18 and/or an intermediate hand grip 20 to facilitate gripping and operating the mop 10. In the embodiment shown, the proximal hand grip 18 is a pistol-type grip and the intermediate hand grip has a plurality of depressions 22 to receive the fingers of a hand. The grips 18, 20 may be made of any appropriate material known to those skilled in the art, such as foam rubber, rubber or a plastic material. In the embodiment shown in FIG. 1, the pistol grip is made of a hard plastic partially covered with a softer, non-skid polymer for gripping, and the intermediate hand grip is made of foam rubber. A wringing lever 24 is pivotally attached to the handle 12 at pivot point 26, such as provided by a rivet, screw or the like and provides wringing action via a mechanical linkage described below. Alternatively, the pivotal attachment may be provided by a pair of pins that extend inwardly from the wringing lever 24 and engage apertures provided in the handle 12. In the embodiment shown, the wringing lever 24 is forked and straddles the handle 12. The wringing lever 24 may be provided with a grip 28 to facilitate grasping with the hand. As indicated by the wringing lever 24' illustrated in dotted lines and the double-ended arrow, the wringing lever 24 may be pivoted through a range of motion.

The pad support assembly 14 has a pad plate 30 coupled to the flared end 32 of collar 34. The collar 34 is pinned by pin 36 to an internal linkage to be described below and is thereby moveable to a position 34' by pulling on the wringing lever 24 in the direction of the phantom depiction thereof (24'). Note that this action causes the pad plate 30 to perform a wringing action which is not shown in FIG. 1, but is shown, e.g., in FIGS. 2 and 3, and described below. The pad plate 30 may be stiffened by the use of webs 38 which resist flexion while minimizing weight and material use. The pad support assembly 14 is preferably made from known injection molded plastics, and the handle, which is generally tubular, may be made from similar plastics, steel or aluminum.

The cleaning pad 16 has a plastic backer 40 to which a sponge 42 or other type of absorbent material in the form of a pad is attached, e.g., by gluing or plastic welding. The sponge pad may be made in accordance with the disclosure of U.S. application Ser. No. 11/280,962 filed Nov. 16, 2005 and U.S. application Ser. No. 11/529,558 filed Sep. 28, 2006, both entitled "Disposable Liquid Absorbing Cleaning Pad for a Hand Held Cleaning Implement Having an Elongated Handle", such applications being incorporated by reference in their entirety herein. In the embodiment shown in FIG. 1, the sponge has two layers, a first layer 42*a* of fine porosity and small cell size, such as a melamine foam. The second layer 42*b* is a larger cell size, course porosity sponge. The first and second layers can be attached to each other using glue or heat.

The backer 40 supports a pair of conventional fasteners 44, 46, such as screws, that insert through openings 48, 50 in the pad plate 30 and are retained in association therewith by mating nuts 52, 54. Other conventional fasteners such as expanding clips may be used for this purpose. The backer 40 features a plurality of V-shaped flexible ribs 56 which support the sponge 42 and allow it to be folded approximately in half for wringing. The backer 40 may be provided with prominences 58 that mate with corresponding structures 60 provided on the pad plate 30 and that facilitate registration of the cleaning pad 16 with the pad plate 30 and may also function as standoffs to allow any liquid which seeps behind the cleaning pad 16 and into the spaces in the pad plate 30 between webs 38 to drain.

Figure 2:
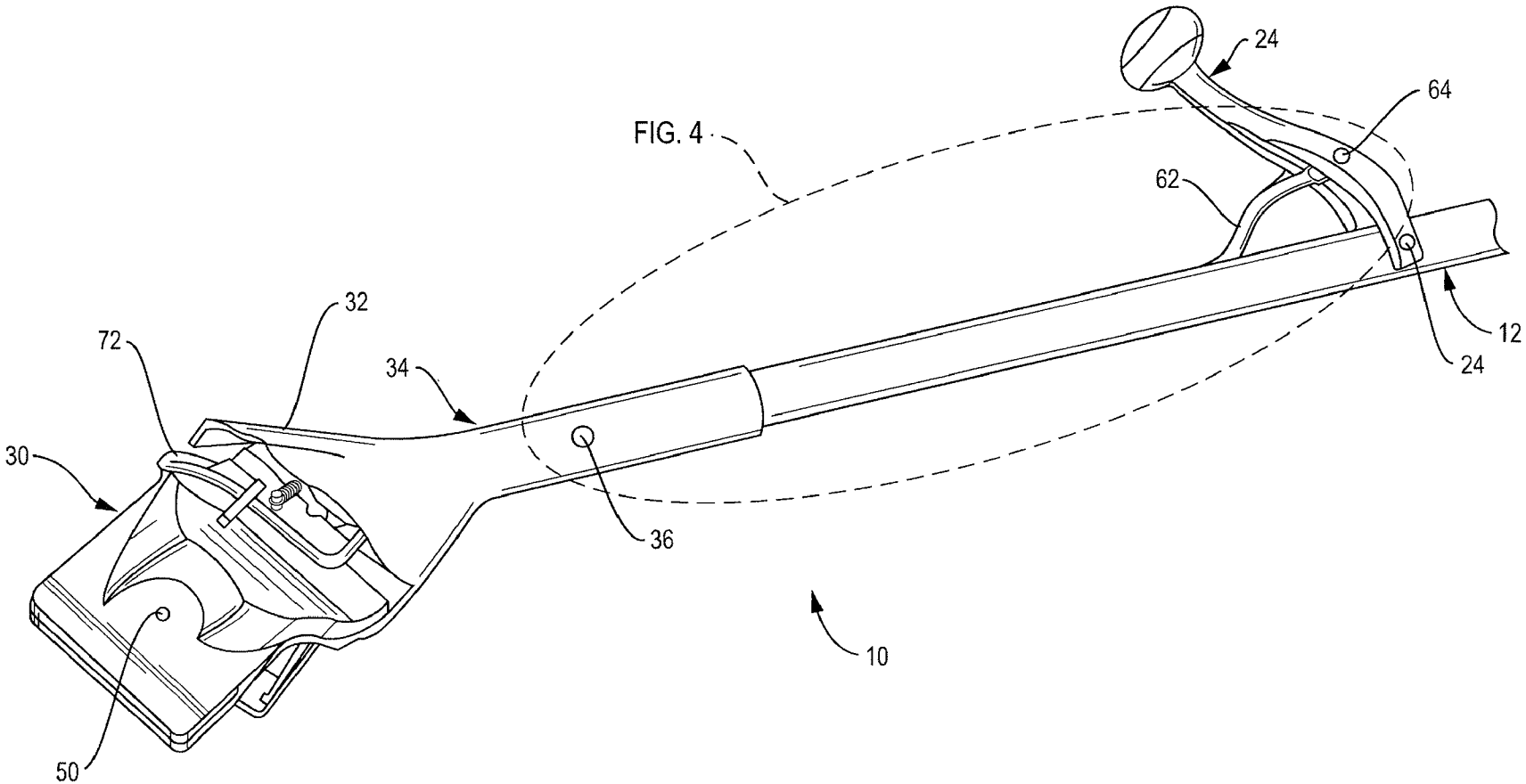
FIGS. 2 and 3 are enlarged fragmentary views of the mop of FIG. 1 in two different states of operation.
Figure 3:
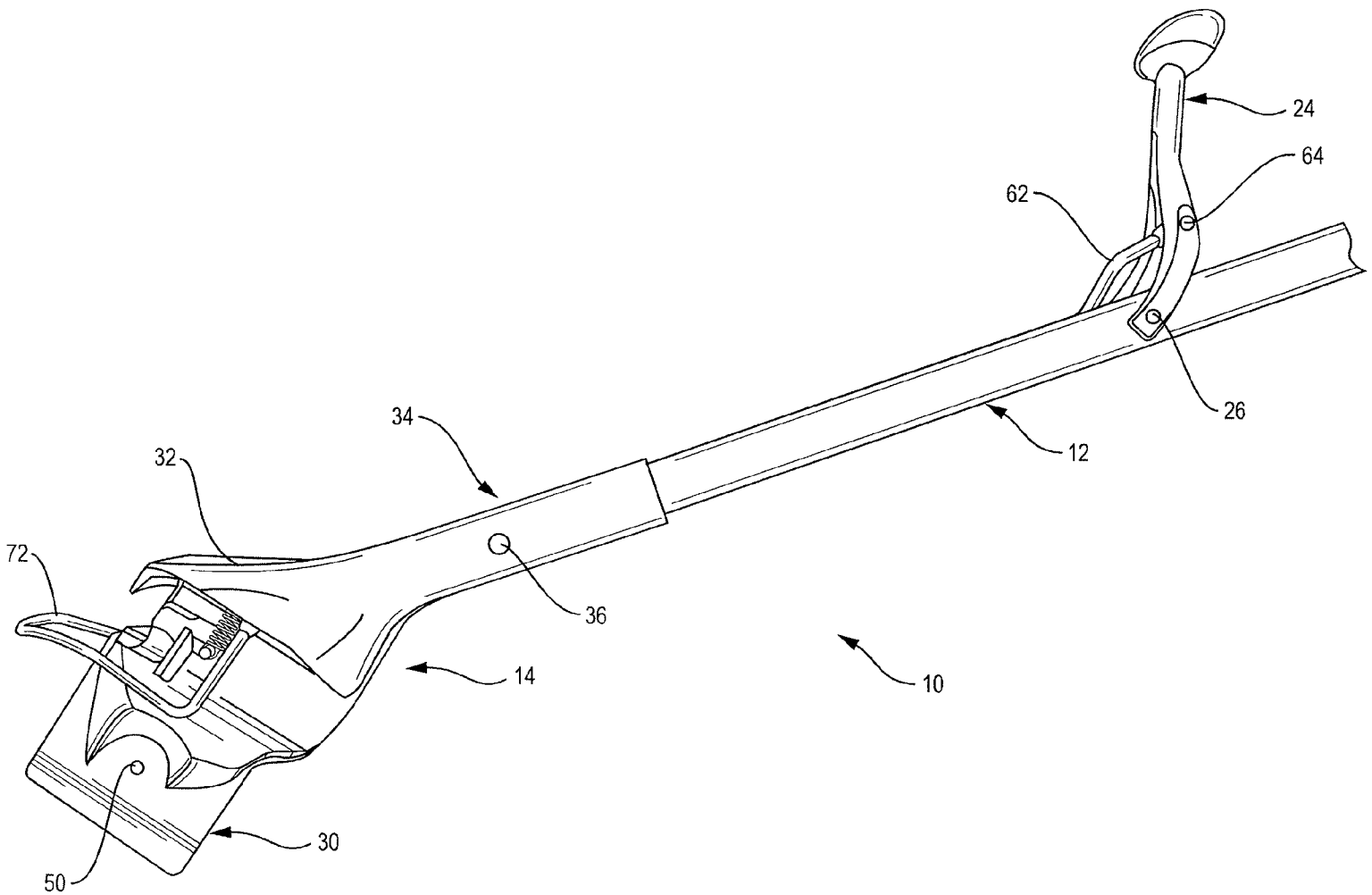
Figure 4:
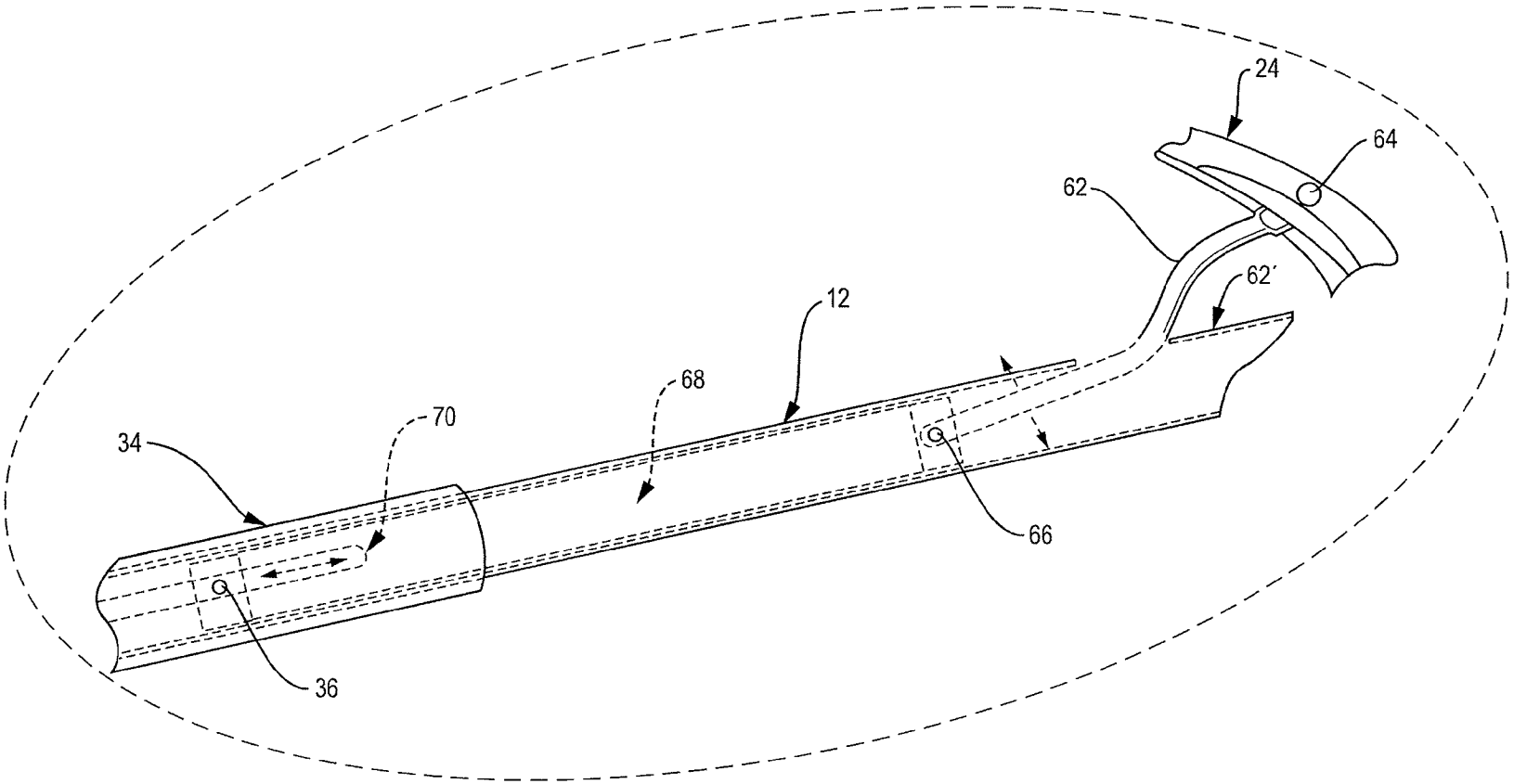
FIG. 4 is an enlarged phantom view of a fragment of the mop of FIG. 2.

FIGS. 2 and 3 show the mop 10 with the wringing lever 24 pivoted proximally (partially—FIG. 2 and fully—FIG. 3) to perform wringing. When the wringing lever 24 is pivoted proximally, it draws intermediate rod 62, which is pivotally pinned thereto by pin 64, in a proximal direction. As shown in FIG. 4, intermediate rod 62 is pivotally connected via pin 66 to a plunger 68, slideably contained within the interior bore of the tubular handle 12. The plunger 68 is pinned at the other end to collar 34 by pin 36, the pin 36 extending through collar 34, plunger 68 and the handle 12 and traversing a slot 70 in the handle 12 when the plunger 68 is moved. As a result, rotation of the wringing lever 24 about the pivot point 26 induces the collar 34 to move relative to the handle 12. As shown in FIGS. 2 and 3, when the collar 34 is moved in a proximal direction relative to the handle 12, it draws the entire pad support assembly 14, including the pad plate 30 in a proximal direction, drawing the pad plate 30 through a wringing frame 72 attached to the handle 12, to wring a cleaning pad 16 supported on the pad plate 30. For simplicity of illustration, the cleaning pad 16 is not shown installed on the mop 10 in FIGS. 2 and 3, but it will be readily appreciated upon full consideration of this specification that a cleaning pad 16 like that shown in FIG. 1 which is retained by fasteners 44, 46 extending through apertures 48, 50 (only 50 is visible in FIGS. 2 and 4) would be folded upon itself, squeezing liquid from the cleaning pad, when wringing is conducted.

Figure 5:
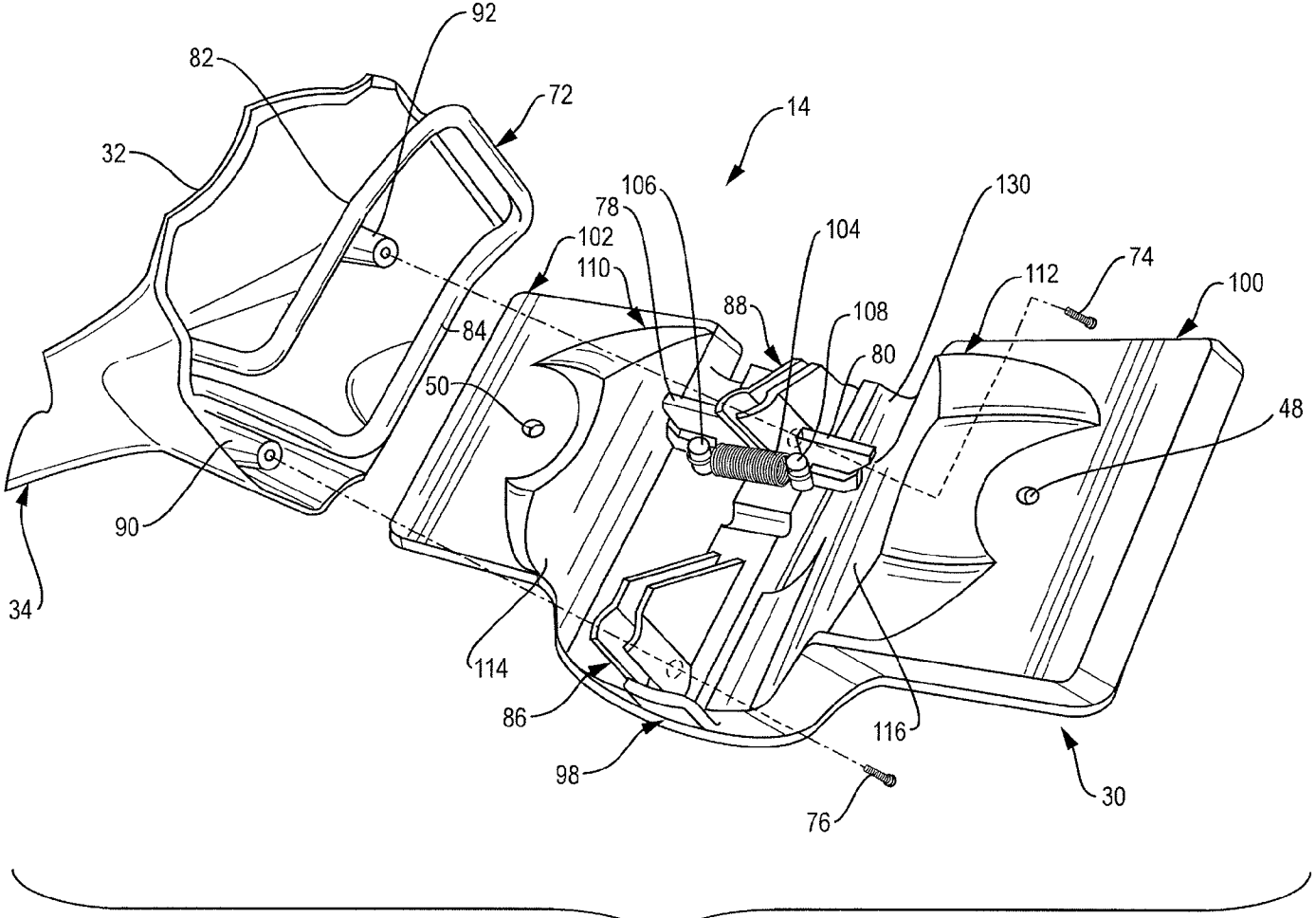
FIG. 5 is an exploded perspective view of a distal portion of the mop of FIGS. 1-4.
Figure 6:
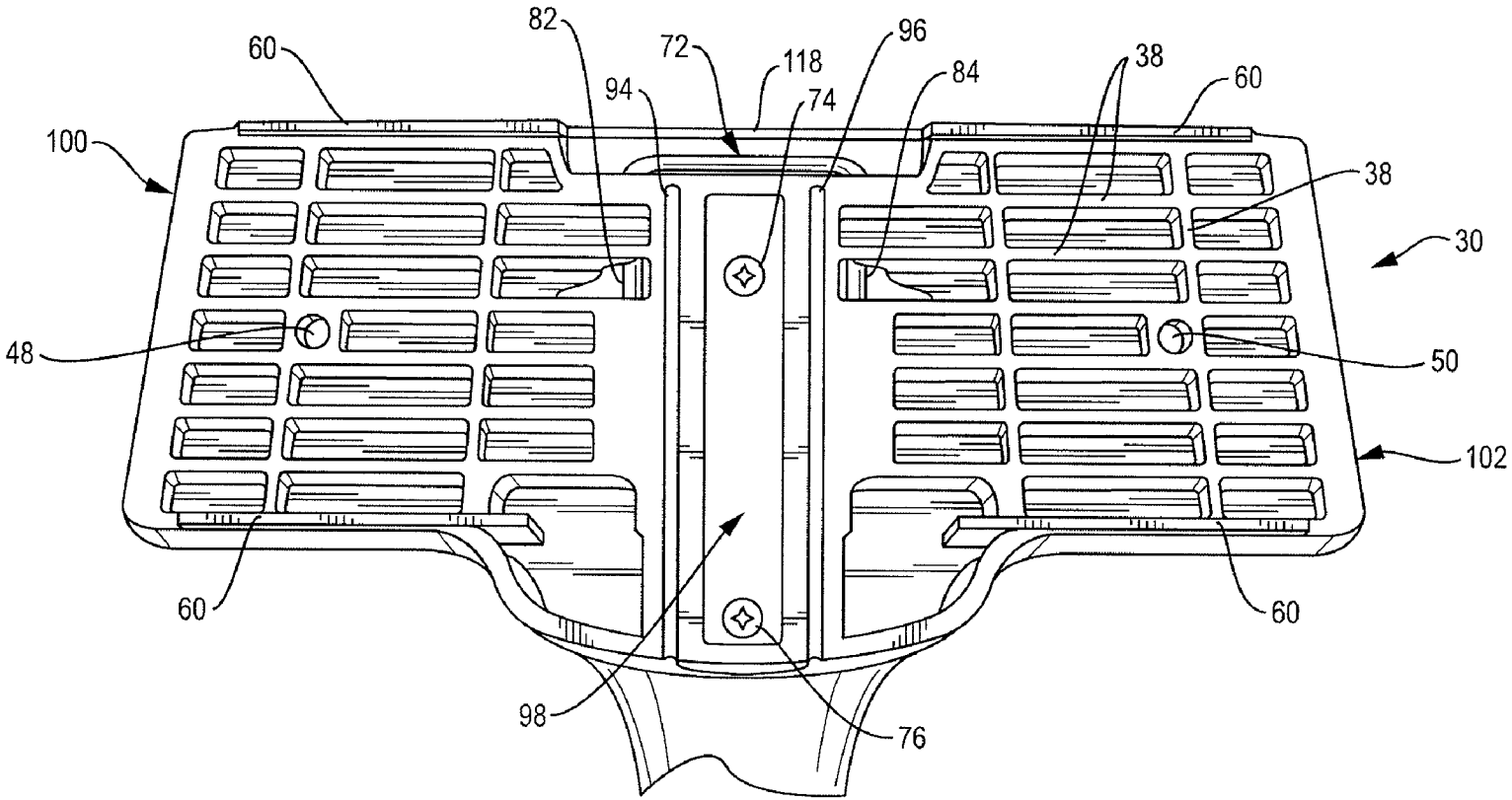
FIG. 6 is an enlarged bottom view of the mop of FIGS. 1-5.

FIGS. 5 and 6 illustrate the pad support assembly 14, with FIG. 5 showing the proximal surface of the pad support 30 and FIG. 6 showing the distal surface. The pad plate 30 is fastened, e.g., by screws 74, 76 to flared end 32 of the collar 34. Alternatively, the pad plate 30 could be affixed to the collar 34 by adhesives, blind rivets or plastic welding. In one assembly order, the wringing frame 72 is affixed to the handle 12, then the collar 34 is slipped over the proximal end of the handle 12 and slid down near the wringing frame 72. The pad plate 30 has a pair of hooks 78, 80, which receive corresponding branches 82, 84 of the wringing frame 72 therein when the pad support assembly is in an assembled state. Accordingly, when assembling the pad plate 30 to the collar 34, the branches 82, 84 of the wringing frame 72 are first threaded into the hooks 78, 80 and then the screws 74, 76 may be used to secure the pad plate 30 to the collar 34. The pad plate 30 features bifurcated, webbed braces 86, 88 that receive apertured posts 90, 92 therein and in cooperation therewith provide structural rigidity and proper alignment of the pad plate 30 and collar 34, e.g., to facilitate threading the screws 74, 76 into the apertured posts 90, 92 and spacing and orienting the pad plate 30 relative to the collar 34.

The pad plate 30 has a pair of plastic hinges 94, 96 (FIG. 6), which functionally divide the pad plate 30 into a central, attachment portion 98 (through which the screws 74, 76 extend to attach the pad plate 30 to the collar 34), flanked by a pair of flap portions 100, 102, which are folded towards one another in opposition when the pad plate 30 is drawn through the wringing frame 72, as shown, e.g., in FIG. 2, squeezing an attached cleaning pad 16. In the embodiment shown, the pad plate 30 is monolithic and bends at plastic hinges 94, 96, but the same functionality could be provided by mechanical hinges intermediating between the attachment portion 98 and the flap portions 100, 102, which could be discrete parts. The plastic hinges 94, 96 may be the same material as the flap portions 100, 102, or they may be a different flexible material, such as a rubber, that is fixed to the pad plate by glue or other means, or is fixed to the pad plate in the molding process. In the embodiment shown, a spring 104 extending between mounting posts 106, 108 resiliently urges the flap portions 100, 102 into a flat (unfolded) configuration. Each of the flap portions 100, 102 are provided with a bracing wedge 110, 112, which provides rigidity to the corresponding flap portion 100, 102 and which features a cam surface 114, 116, which slideably engages the wringing frame 72 to progressively squeeze the flap portions 100, 102 toward one another when wringing. Note that in FIG. 6, which shows the pad support 30 in the flat (non-wringing or mopping) configuration, the distal end of the wringing frame 72 is retracted into the pad support assembly, i.e., behind and below lip 118.

Figure 7:
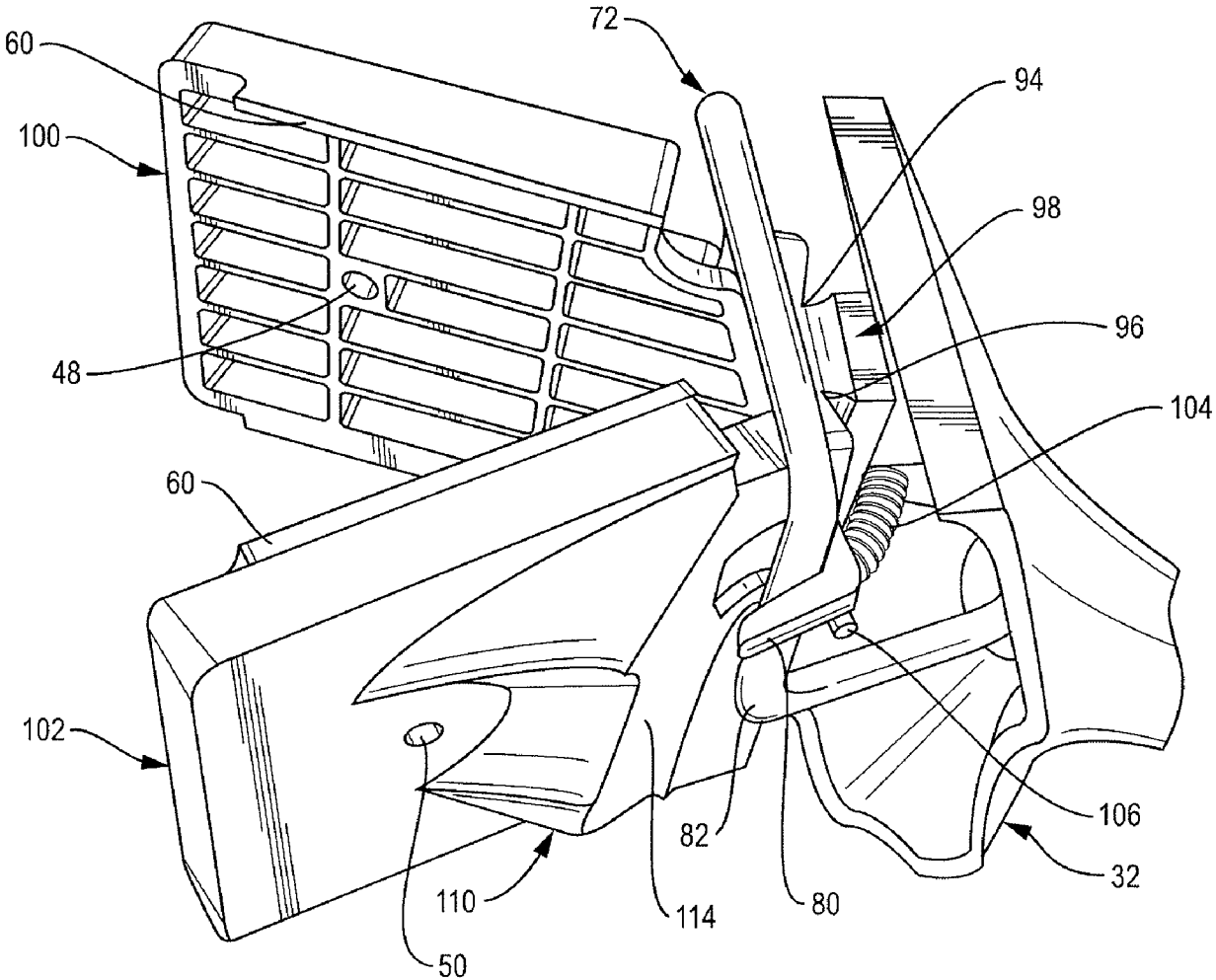
FIGS. 7 and 8 are enlarged perspective views of the mop of FIGS. 1-6 in two different states of operation.
Figure 8:
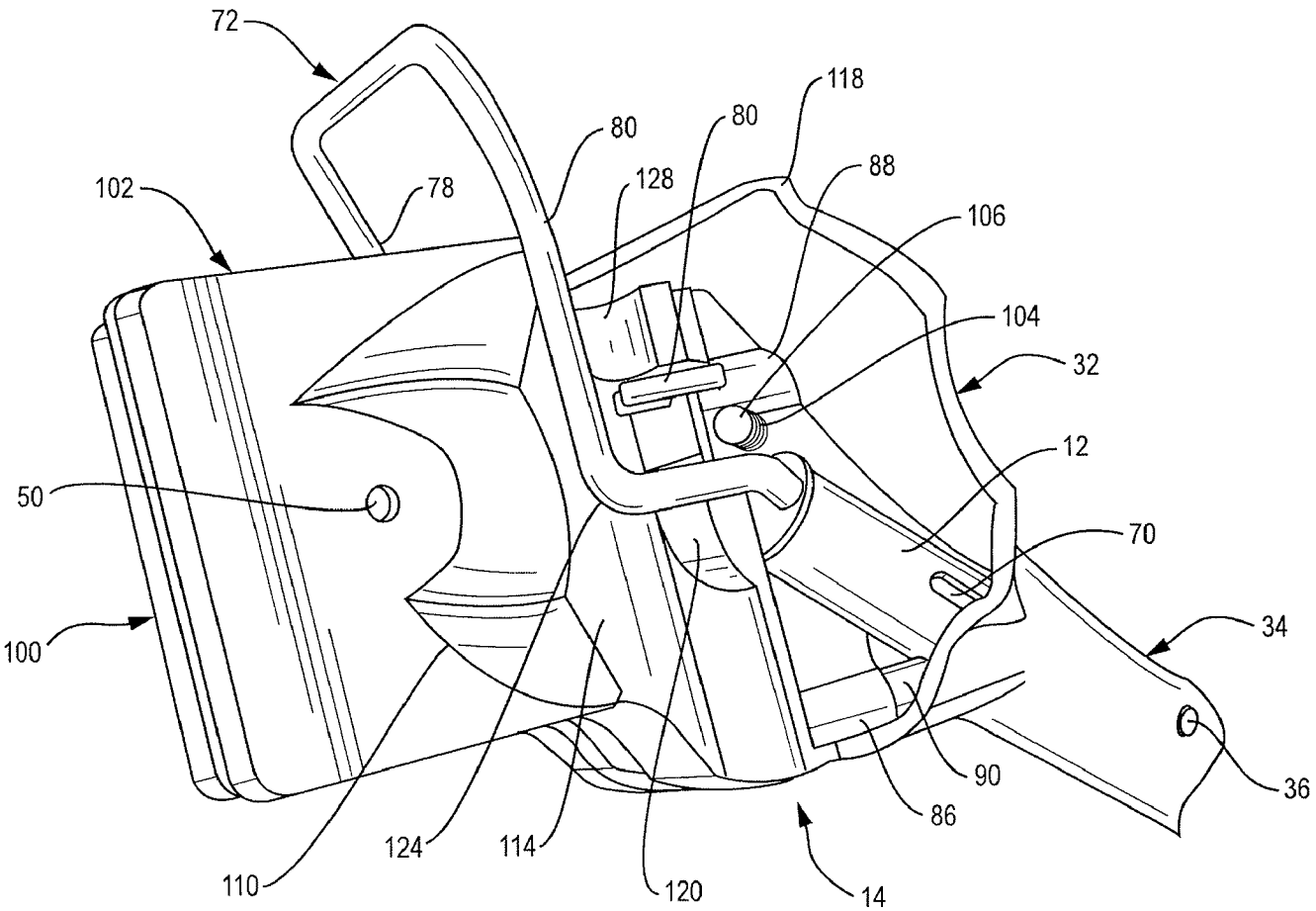

FIGS. 7 and 8 depict the mop 10 in states approximating those illustrated in FIGS. 2 and 3, respectively, i.e., when the wringing lever 24 is in an intermediate position (FIGS. 2 and 7) and fully pivoted in a proximal direction (FIGS. 3 and 8). In FIG. 7, branch 82 of the wringing frame 72 is seated within hook 80, a condition which could exist either at an intermediate stage of wringing, i.e., prior to full retraction of the pad support assembly, or after wringing when the pad plate 30 is being pushed back through the wringing frame 72 to assume a flat (non-wringing) configuration. As can be appreciated, the hooks 78, 80 can assist the spring 104 in returning the pad plate 30 to a flat configuration. As shown in FIGS. 7 and 8, the further the pad support assembly 14 is retracted relative to the handle 12 and the wringing frame 72, the further the branches 78, 80 of the wringing frame 72 ride up the cam surfaces 114, 116 of the bracing wedges 110, 112 and the closer the opposing distal surfaces of the flap portions 100, 102 approach one another, thereby progressively squeezing a cleaning pad 16 that is attached to the pad plate 30.

Figure 9:
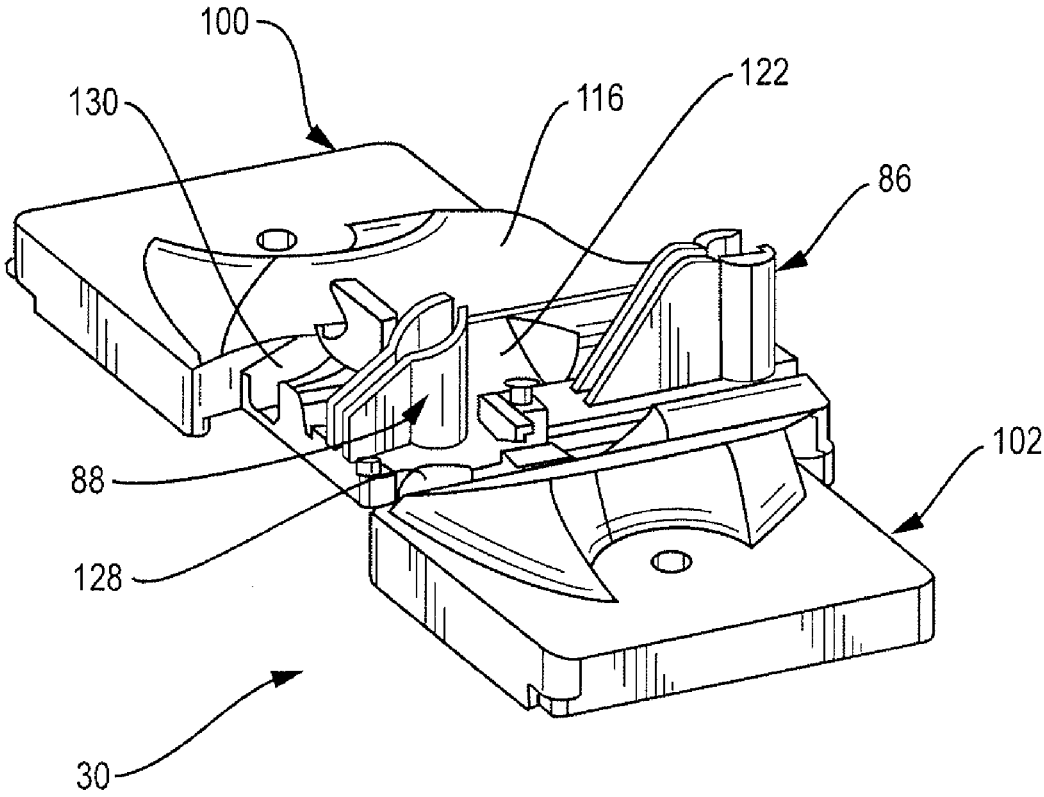
FIG. 9 is a perspective view of a pad plate of the mop of FIGS. 1-8.
Figure 10:
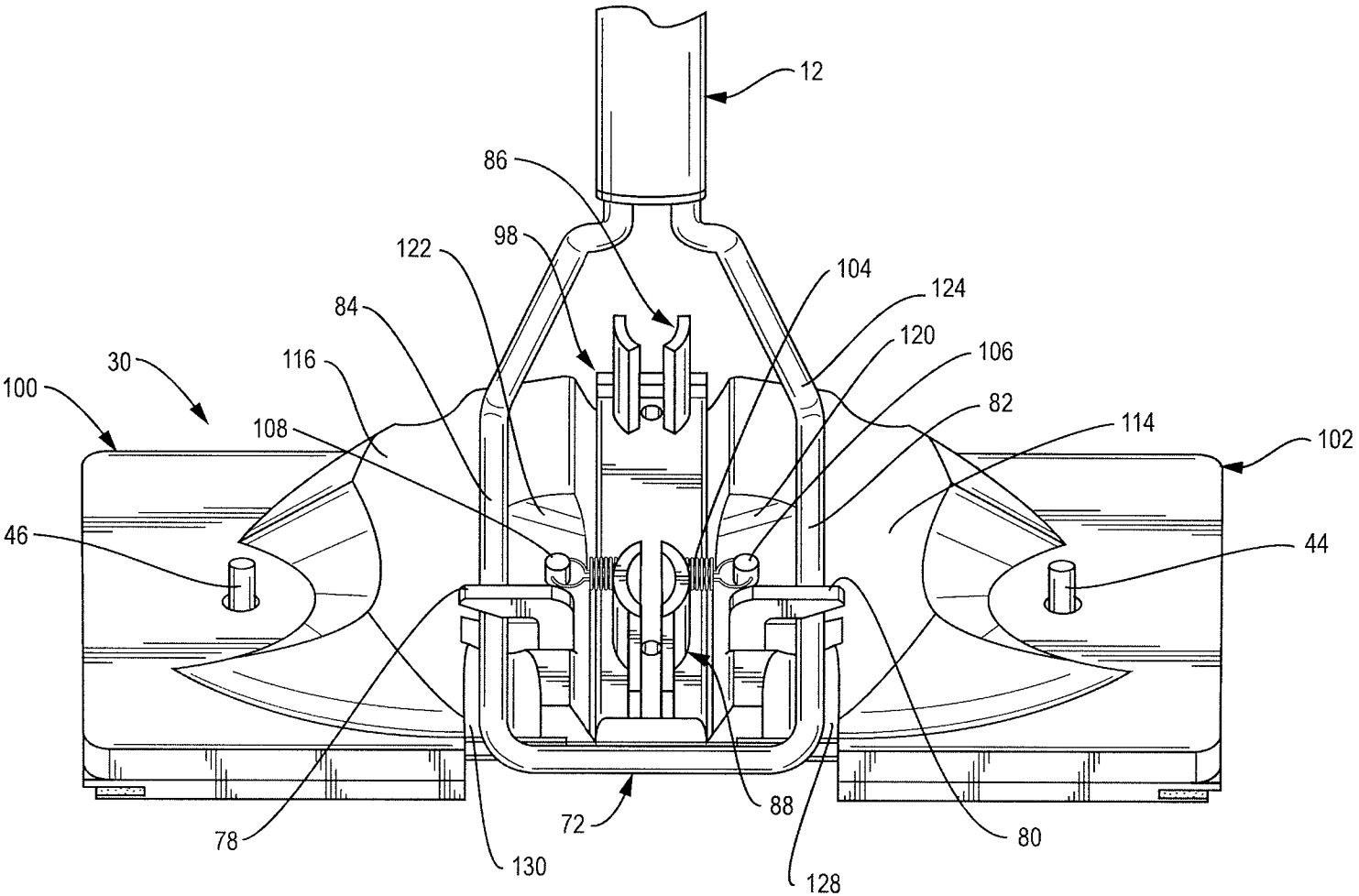
FIG. 10 is a top view of the pad plate of FIG. 9 installed on a wringing frame of the mop of FIGS. 1-9.

In FIG. 8, the pad support assembly 14 is retracted fully, relative to the handle 12, forcing the branches 78, 80 of the wringing frame 72 high on the cam surfaces 114, 116, squeezing the flap portions 100, 102 together. A relief 120 is provided on the proximal surface of the flap portion 102 to permit the wringing frame 72 (at bend 124) to pass, while preserving structural rigidity of the flap portion 102. A similar relief 122 is present on the flap portion 100 (FIGS. 9 and 10). A recess 128 is adapted to receive a corresponding portion of the wringing frame 72 when it is retracted fully into the flared end 32 of the collar 34, with the pad plate 30 in a flat configuration.

FIG. 9 shows the pad plate 30 from a perspective from which relief 122 and recess 130 (corresponding to recess 128) are visible.

FIG. 10 shows the pad plate 30 with the wringing frame threaded into the hooks 78, 80 and before attachment to the collar 34 (not shown).

Figure 11:
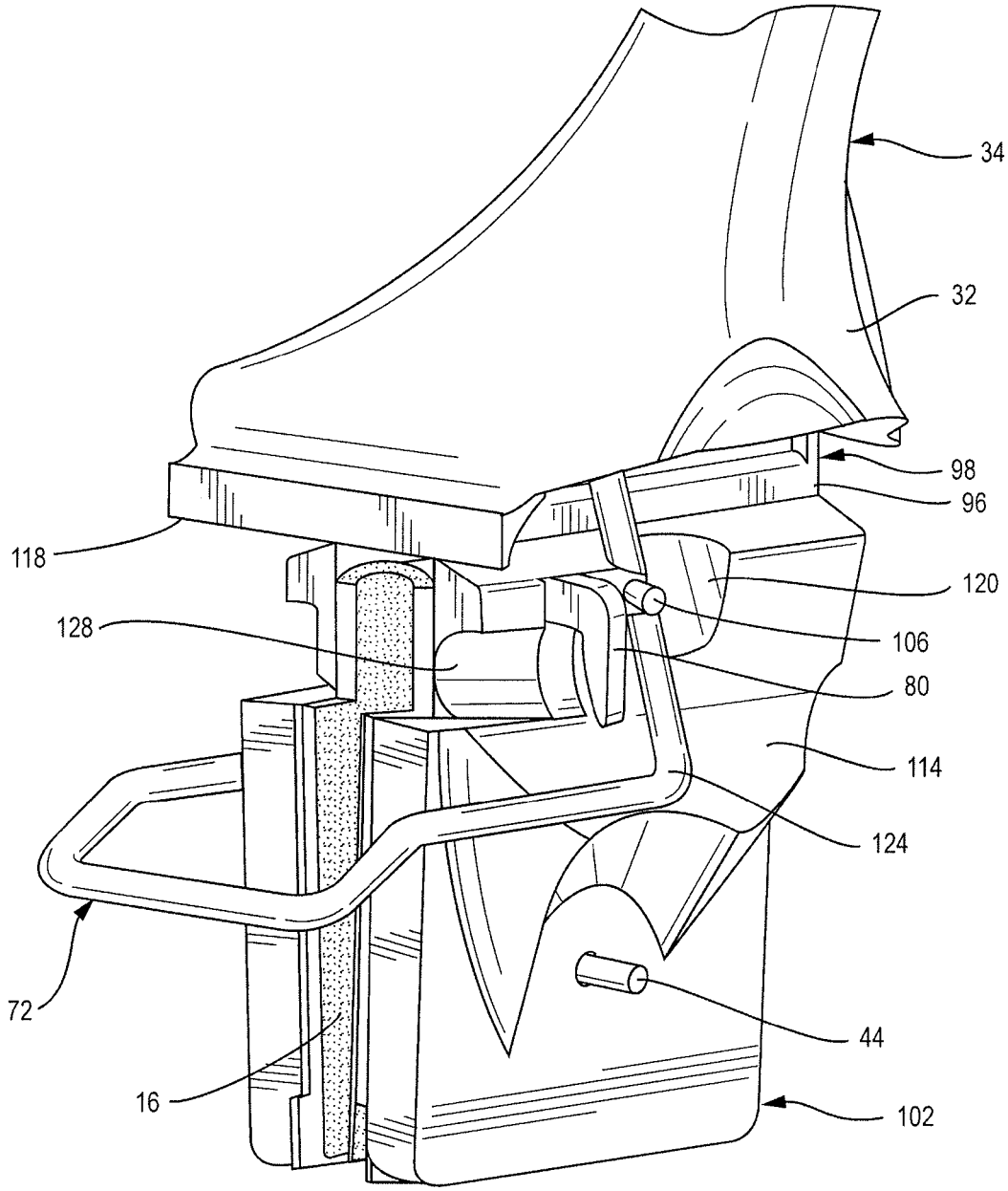
FIG. 11 is an enlarged perspective view of a distal portion of the mop of FIGS. 1-10 in wringing position.

FIG. 11 shows the mop in a wringing position, with a cleaning pad 16 present (retainer nut 54 absent).

Figure 12:
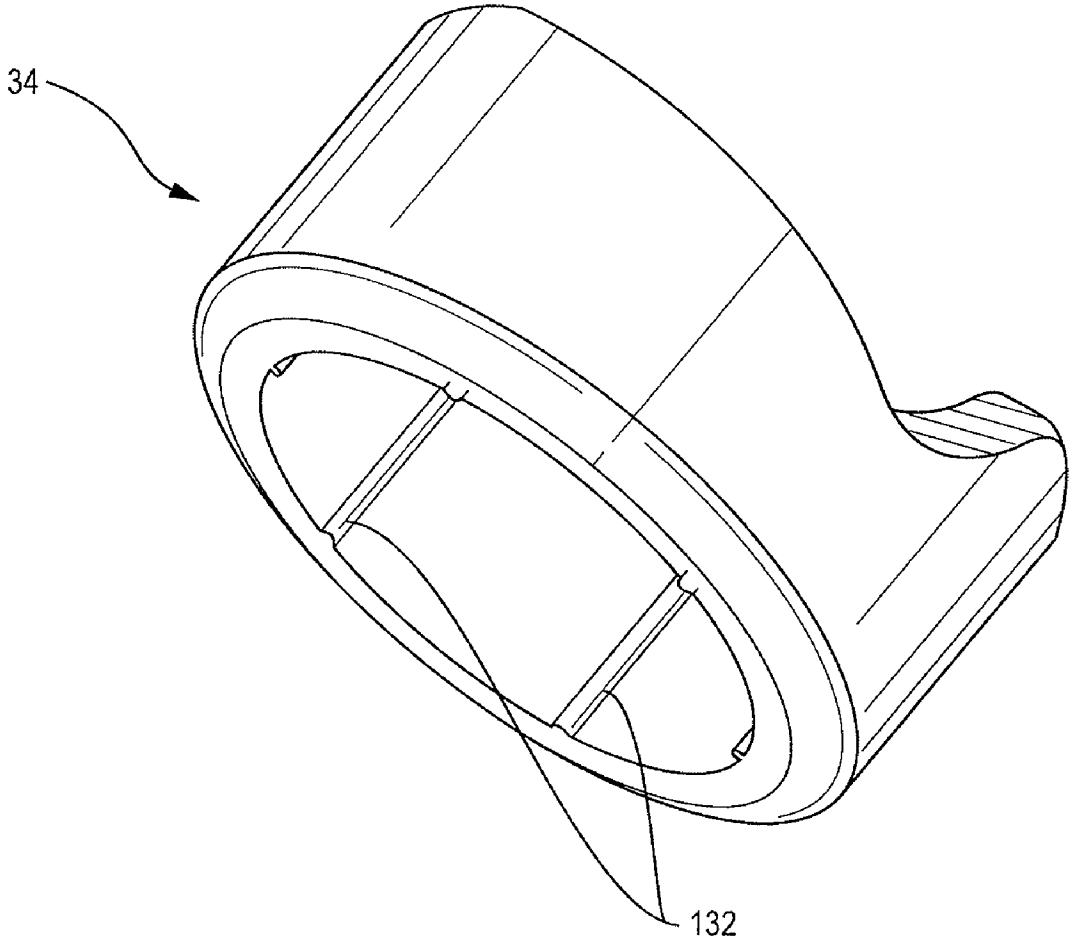
FIG. 12 is an enlarged perspective view of an end of a collar of the mop of FIGS. 1-11.

FIG. 12 shows an embodiment of the collar 34, which employs a plurality of internal ridges 132 that may be used to reduce frictional interaction between the collar 34 and the handle 12 by reducing contact area. In addition, the ridges 132 permit any fluid between the collar and the handle to drain, reducing the possibility of the handle 12 rusting or the growth of bacteria and mold.

Figure 13:
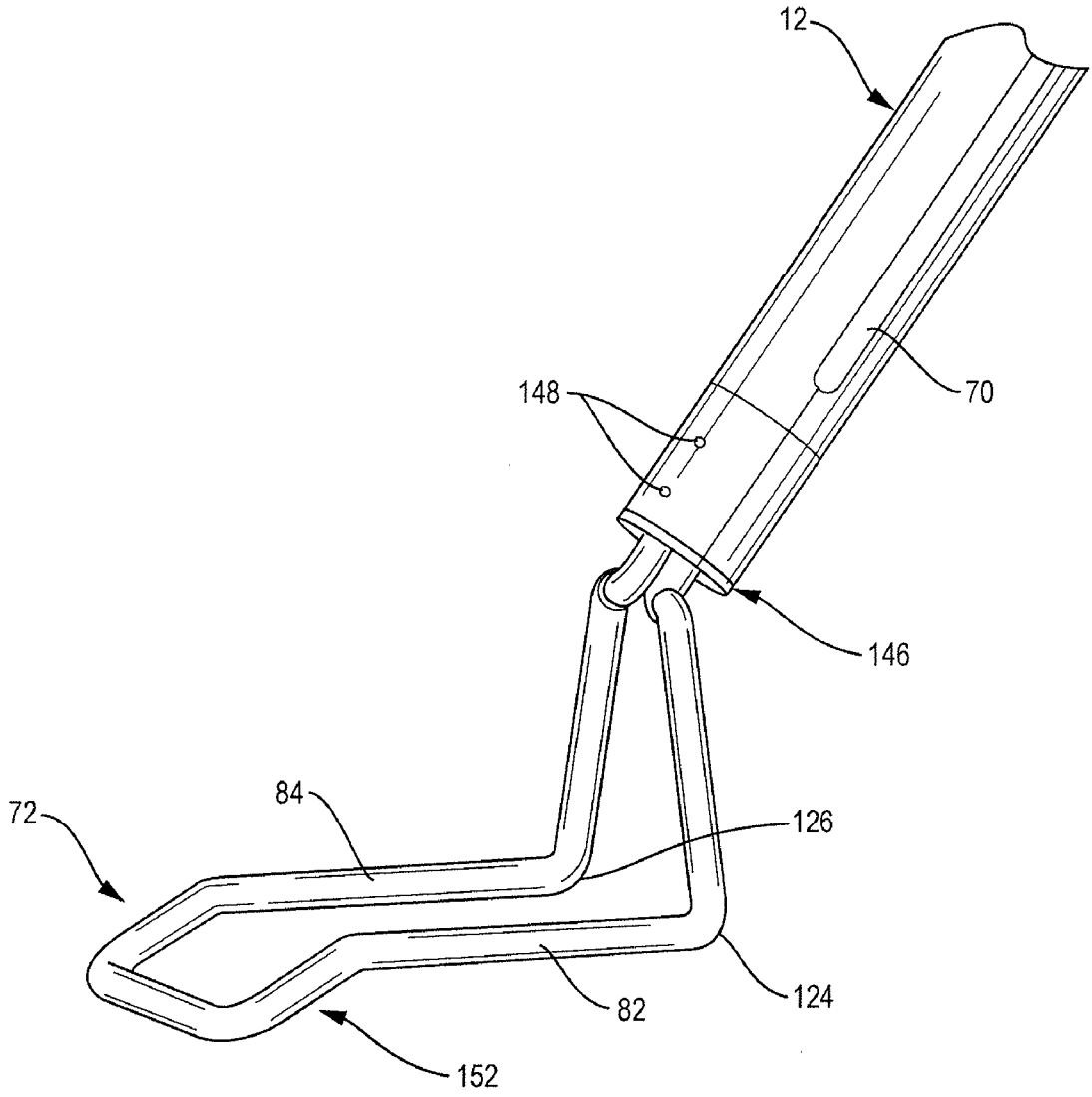
FIG. 13 is an enlarged perspective view of a wringing frame and handle of the mop of FIGS. 1-12.
Figure 14:
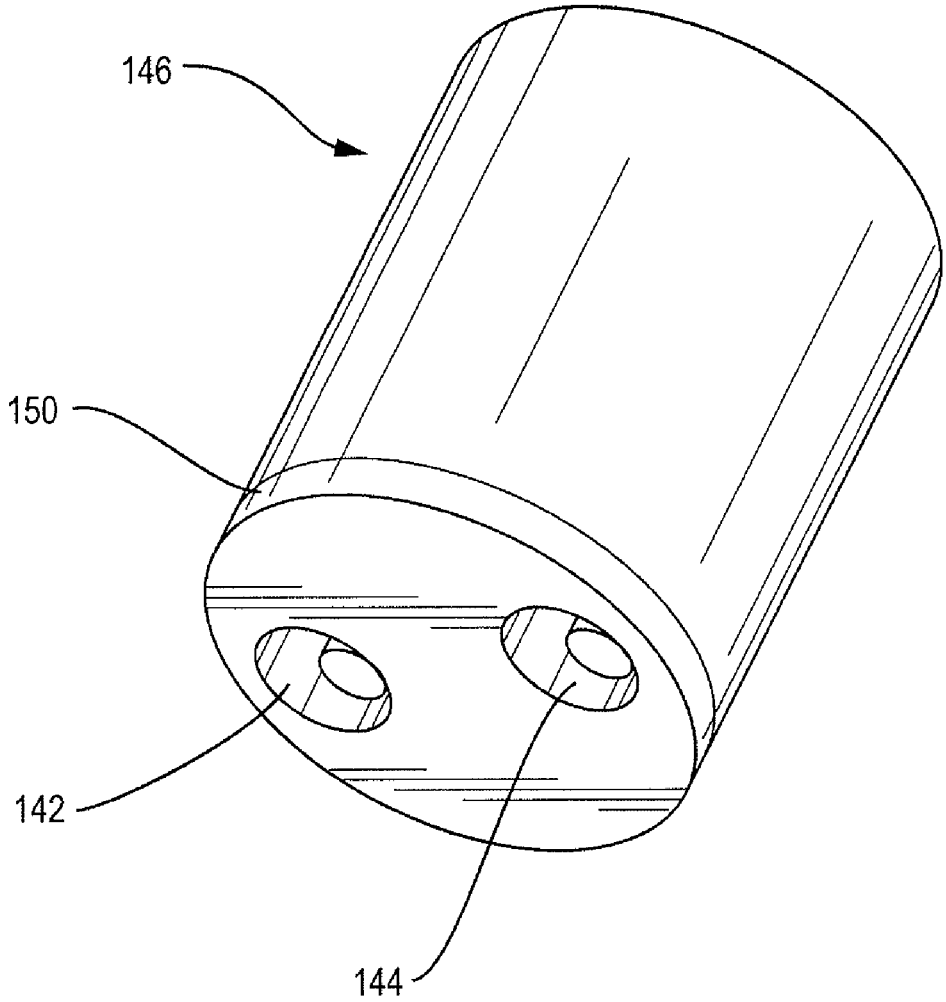
FIG. 14 is an enlarged perspective view of a wringing frame retention plug of the mop of FIGS. 1-13.
Figure 15:
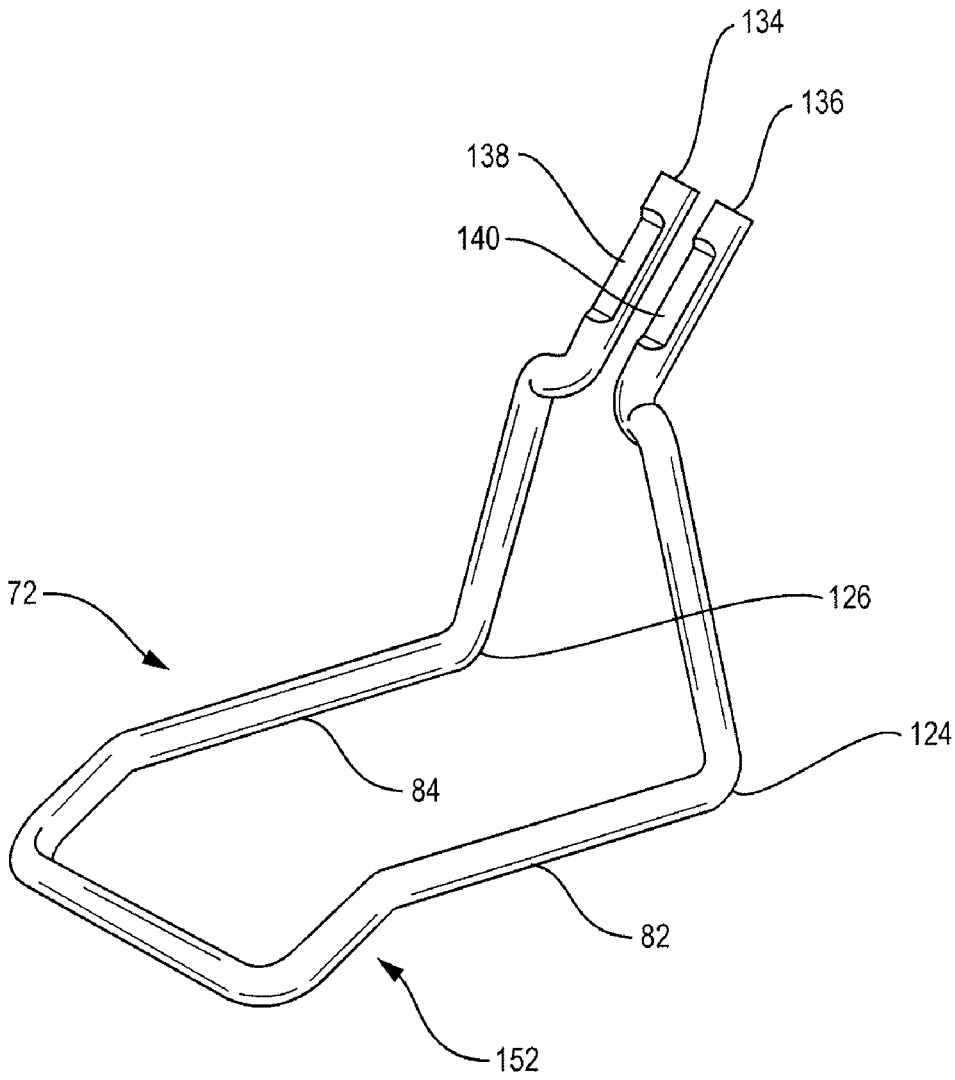
FIG. 15 is an enlarged perspective view of a wringing frame of the mop of FIGS. 1-14.

FIG. 13 shows the wringing frame 72 attached to handle 12 with slot 70 visible. As can be appreciated from FIGS. 13, 14 and 15, the wringing frame 72 may be formed from a length of rigid metal rod, e.g., stainless steel or steel plated or otherwise coated with a corrosion-resistant coating. The rod is formed into a loop with ends 134, 136 having flats 138, 140. The ends 134, 136 are pushed into mating apertures 142, 144 of a mounting plug 146 preferably made from a polymeric material, such as for example, polypropylene or polystyrene. The plug 146 is then inserted into an end of the handle proximate slot 70 and retained there by staking 148. The staking 148 may be aligned with the flats 138, 140 to locally displace the plug 146 inwardly proximate the flats 138, 140 to enhance their retention in the plug 146. Alternatively, the plug 146 may be retained in the handle by a pin, rivets, a screw, adhesives, or other conventional methods. The plug 146 may also be molded around the ends 134, 136 to insure secure attachment thereto. The plug 146 may be provided with an annular lip 150 for controlling the depth of insertion of the plug 146 into the handle 12. The embodiment of the wringing frame 72 shown, features an offset portion 152, which is shaped to approximate the interior shape of the flared end 32 of the collar 34 proximate the lip 118 to allow full relative retraction of the wringing frame 72 into the pad support assembly 14.

Figure 16:
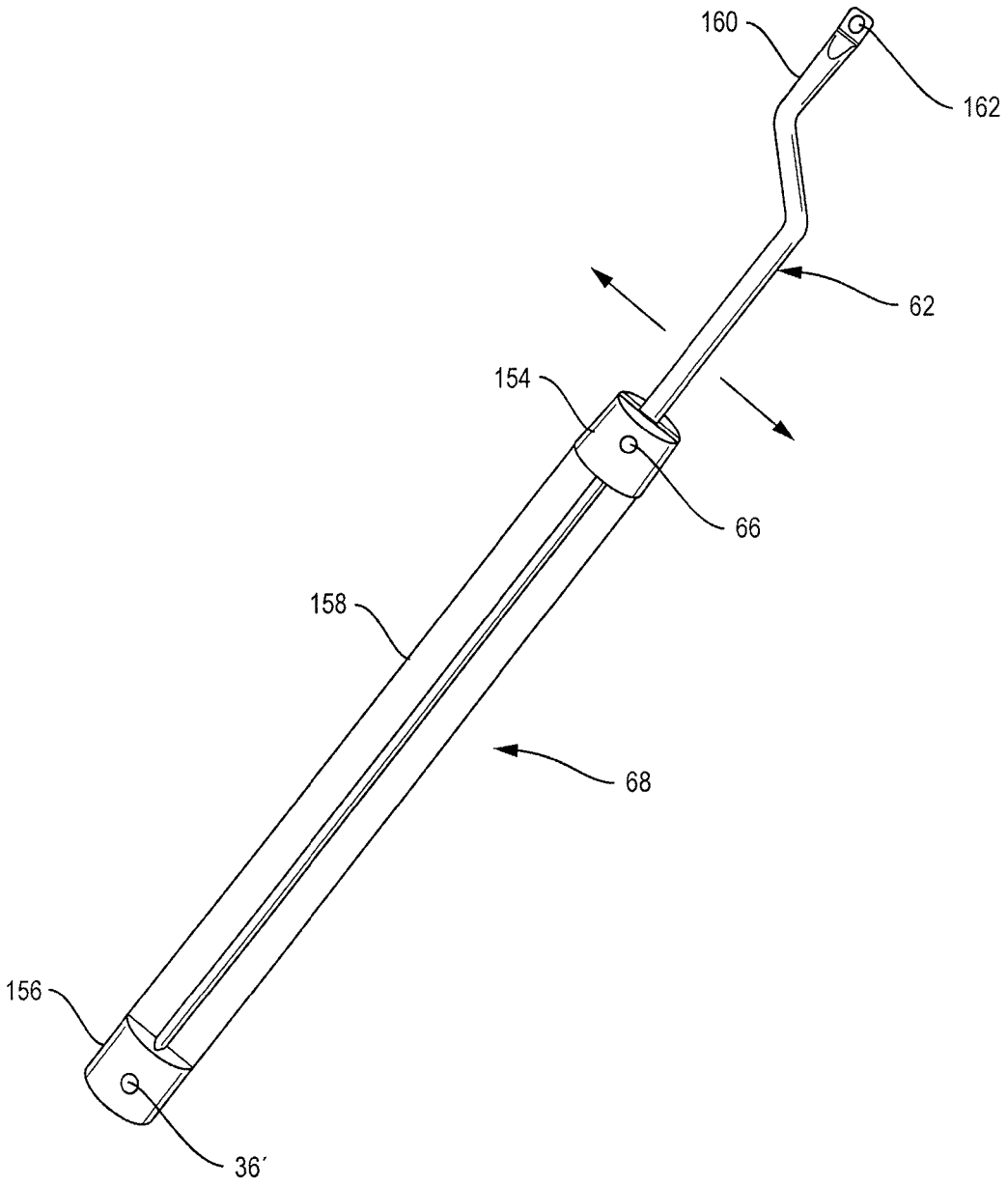
FIG. 16 is an enlarged perspective view of a plunger and intermediate rod of the mop of FIGS. 1-15.

FIG. 16 shows the intermediate rod 62 pivotally pinned to plunger 68 via pin 66. The other end of the plunger 68 has an aperture 36' for receiving pin 36 which extends through slot 70 (See FIG. 4) and joins the collar 34 to the plunger 68. In the embodiment shown, the plunger 68 has cylindrical ends 154, 156 and an intermediate spreader 158 having a cruciform cross-sectional shape for material conservation and to reduce frictional interaction with the handle 12. The plunger 68 slides within the handle 12 in piston-cylinder relationship and may have a variety of cross-sectional shapes, such as triangular, square, hexagonal, octagonal, star, etc. The intermediate rod 62 has an offset end 160 that allows it to extend through a corresponding slot 62' (FIG. 4) in the handle and attach via aperture 162 to the wringing lever 24 via pin 64 (FIG. 4).

Figure 17:
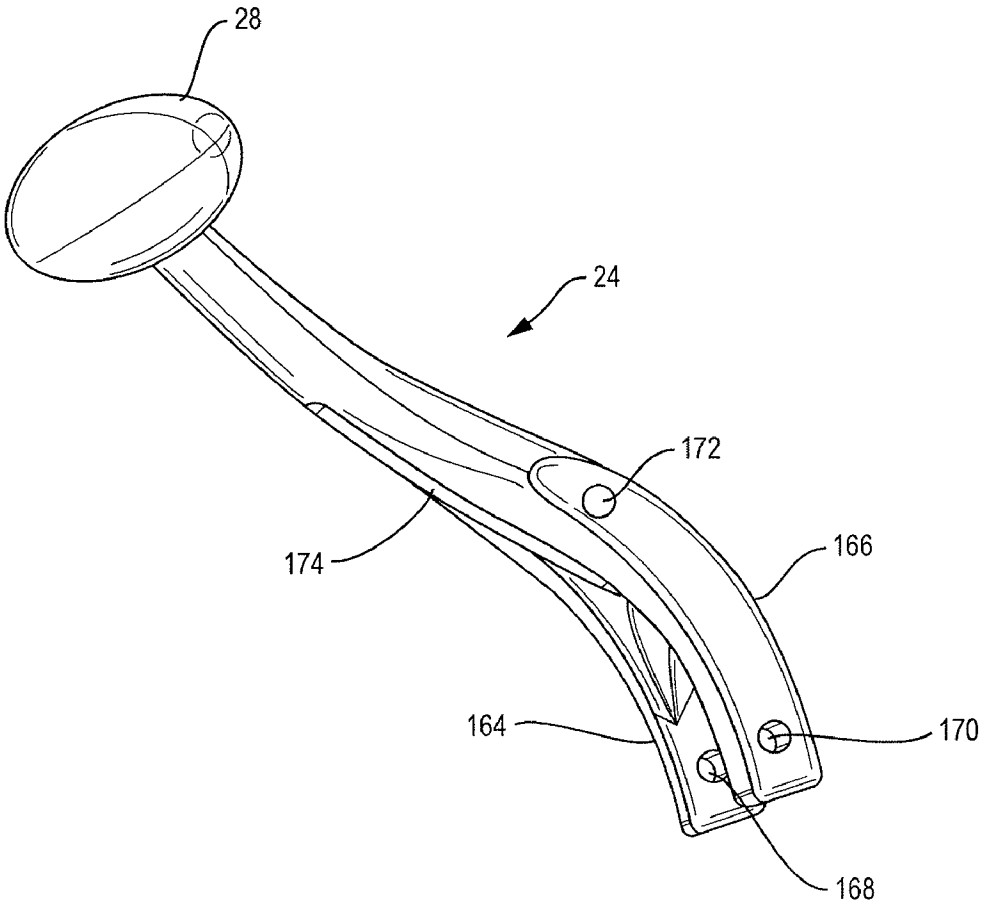
FIG. 17 is an enlarged perspective view of a wringing lever of the mop of FIGS. 1-16.

FIG. 17 shows the wringing lever 24 which has a modified, elongated S-shape to permit it to assume a compact configuration close to the handle 12 when in a non-wringing state. The grip 28 preferably has an ergonomic shape and composition, e.g., a non-skid polymer, such as a rubber, which provides a positive grip when handled by a wet hand. Although a grip 28 may provide ergonomic benefits, it is not required and may be omitted, e.g., for economic reasons. In the embodiment shown, the wringing lever 24 is forked, having a pair of extensions 164, 166, each with apertures 168, 170 for pivotal retention to the handle 12 by a suitable fastener, such as a pin 26 (FIG. 1) rivet, screw, etc. At least one aperture 172 is provided for pivotally connecting the intermediate rod 62 to the wringing lever 24, e.g., by a pin 64 (FIG. 2). A hollow 174 is provided to receive the upper portion of the intermediate rod 62 when the mop 10 is in the non-wringing position.

Figure 18:
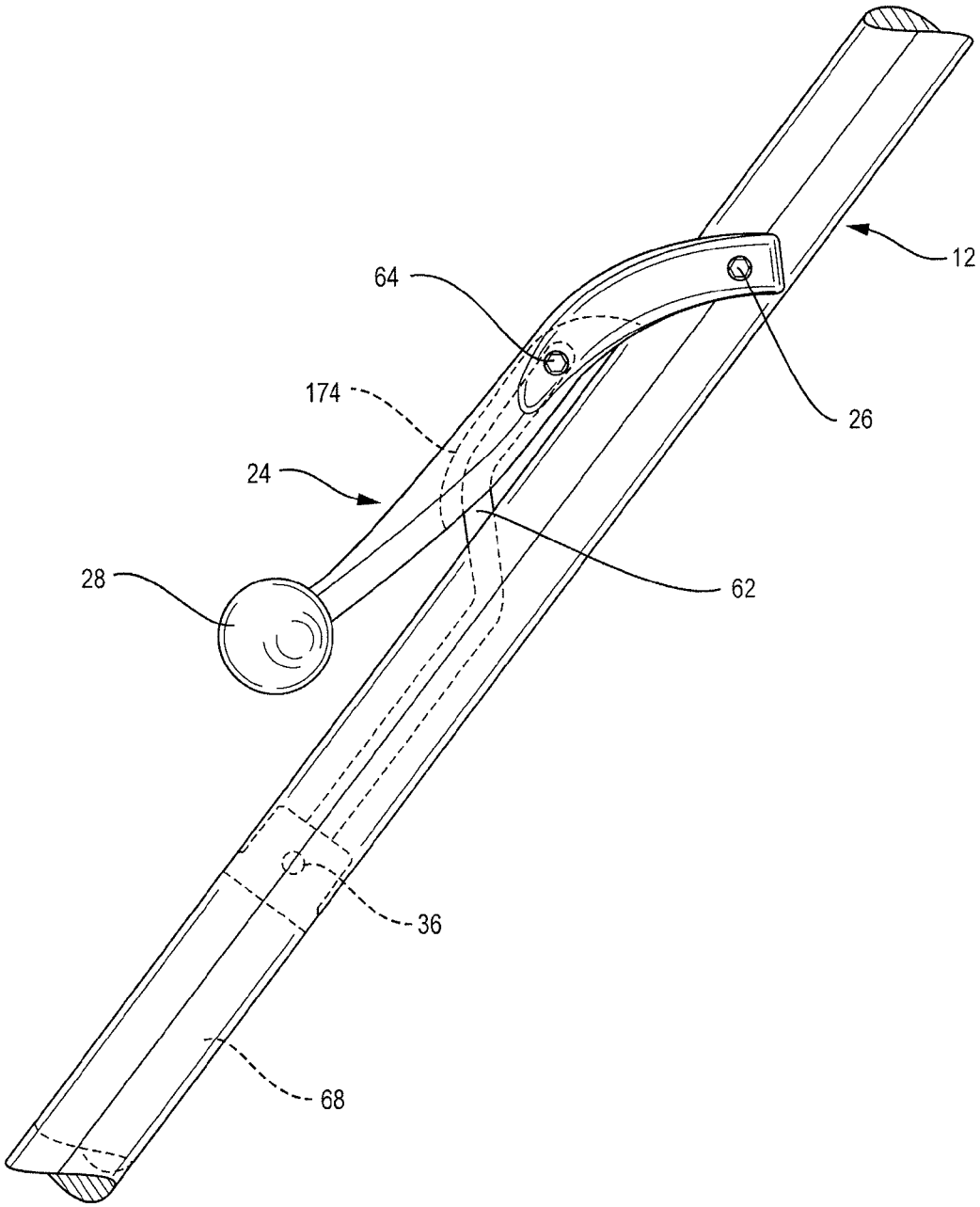
FIG. 18 is an enlarged, partially phantom, side view of the mop of FIGS. 1-17 in a non-wringing state.

FIG. 18 illustrates the relative positions of the handle 12, wringing lever 24, intermediate rod 62 and plunger 68 when the wringing lever 24 is in the non-wringing position and shows the nesting of a proximal portion of the intermediate rod 24 within the hollow 174 of the wringing lever 24.

It should be understood that the embodiments described herein are merely exemplary and that a person skilled in the art may make many variations and modifications without departing from the spirit and scope of the invention. For example, the present invention has been described above in reference to mops with a cleaning pad or sponge, but the wringer apparatus of the present disclosure could be employed with mops having stranded cleaning heads, such as "rag mops".

What is claimed is:

1. A mop, comprising:

a hollow handle having a proximal end for gripping the handle and a pad support assembly coupled at a distal end, including a proximal sleeve portion coaxially slideable about the handle and a distal flanged portion;

a cleaning pad having an absorbent portion removably attached to the pad support assembly;

a wringing frame fixed to the handle at the distal end thereof and received substantially within the distal flanged portion of the pad support assembly, the wringing frame having an opening therein;

an actuator lever coupled to the handle, including a hollow on one side thereof; and a linkage, including an elongated piston located substantially internal to the handle, said piston being coupled at one end to the sleeve portion of the pad support assembly via a coupling member extending through a distal slot in the handle, and further including a rod having a proximal portion, a flattened S-shaped middle portion, and a straight distal portion, said rod extending from within the hollow of the handle to the actuator level, through a proximal slot in the handle, and pivotally attaching to an opposing end of the piston to the actuator lever, wherein when the actuator lever is in a first position, the cleaning pad is in an uncompressed cleaning position, and when the actuator lever is moved to a second position, the linkage draws the cleaning pad into a wringing position, wherein the absorbent portion is at least partially withdrawn into the wringing frame opening and is at least partially compressed, and wherein the proximal portion of the rod is received within the hollow of the lever when the lever is in the first position.

2. The mop of claim 1, wherein the wringing frame opening is defined by opposing spaced members attached to the handle at the distal end thereof.

3. The mop of claim 2, wherein the opposed spaced members are opposing sides of an open loop.

4. The mop of claim 3, wherein said open loop is partially rectangular in shape, the opposing spaced members being substantially parallel.

5. The mop of claim 1, wherein the cleaning pad includes a pad plate supporting the absorbent portion and having a plurality of pivotable flaps, and the wringing frame urges the plurality of flaps towards one another to compress the absorbent portion when the linkage draws the cleaning pad from the cleaning position toward the wringing position.

6. The mop of claim 5, wherein each of the plurality of flaps has a cam surface adapted to translate the movement of the actuator lever from the first position to the second position into a predetermined angular movement of the flaps to accordingly compress the absorbent portion to a selected degree.

7. The mop of claim 6, further comprising a resilient member, which biases the actuator lever from the second position toward the first position and the plurality of flaps from the wringing position toward the cleaning position.

8. The mop of claim 7, wherein each of the plurality of flaps has a constraining member adapted to engage the wringing frame and guide an associated flap toward the cleaning position when the resilient member biases the plurality of flaps thereto.

9. The mop of claim 1, wherein the distal flanged portion of the pad support assembly substantially obscures the wringing frame from view when the cleaning pad is in the cleaning position.

10. The mop of claim 5, wherein the absorbent portion is a sponge.

11. The mop of claim 1, further comprising a hand grip on the proximal end of the handle.

* * * * *